US005284541A

United States Patent [19]

Kambara

[11] Patent Number: 5,284,541

[45] Date of Patent: Feb. 8, 1994

[54] INSULATING TAPE FOR WINDING COILS

[75] Inventor: Kenji Kambara, Otsu, Japan

[73] Assignees: Toray Engineering Co., Ltd., Osaka; Fuji Electrochemical Co., Ltd., Tokyo, both of Japan

[21] Appl. No.: 839,688

[22] Filed: Feb. 24, 1992

Related U.S. Application Data

[62] Division of Ser. No. 611,781, Nov. 13, 1990, abandoned.

[51] Int. Cl.[5] ..... B65H 65/00; H01F 41/00; H01B 19/00

[52] U.S. Cl. ..... 156/192; 156/184; 156/190; 29/605; 29/609; 336/206; 242/7.03

[58] Field of Search ..... 29/631.1, 605, 606, 29/609, 25.41, 361; 336/206, 208; 156/184, 190, 191, 192; 242/7.21, 7.23, 7.02, 7.03

[56] References Cited

U.S. PATENT DOCUMENTS

| | | | |
|---|---|---|---|
| 1,485,289 | 2/1984 | Peterson | 242/7.02 X |
| 2,479,400 | 8/1949 | Pecorini | 336/206 X |
| 2,673,643 | 3/1954 | Blank et al. | 428/189 |
| 3,063,885 | 11/1962 | Kieffer | 428/194 X |
| 3,111,442 | 11/1963 | Voisin | 156/446 X |
| 3,234,063 | 2/1966 | Masini | 156/446 X |
| 3,427,578 | 2/1969 | Gray | 336/206 X |
| 3,692,619 | 9/1972 | Wedekind et al. | 428/190 |
| 4,055,310 | 10/1977 | Bonaiti | 242/7.08 |
| 4,269,367 | 5/1981 | Minami | 242/7.08 X |
| 4,477,036 | 10/1984 | Rundo | 156/184 X |
| 4,854,998 | 8/1989 | Yamaguchi | 428/194 X |
| 4,921,567 | 5/1990 | Criswell | 156/446 X |
| 5,050,292 | 9/1991 | Zirbes | 381/421 |
| 5,125,997 | 6/1992 | Smith | 156/238 X |

FOREIGN PATENT DOCUMENTS

| | | |
|---|---|---|
| 54-124216 | 9/1979 | Japan . |
| 59-2307 | 1/1984 | Japan . |
| 61-53713 | 3/1986 | Japan . |
| 1-71112 | 3/1989 | Japan . |

*Primary Examiner*—David A. Simmons
*Assistant Examiner*—Charles Rainwater
*Attorney, Agent, or Firm*—Burns, Doane, Swecker & Mathis

[57] ABSTRACT

An insulating tape for winding coils which includes a guide sheet having a predetermined width and a plurality of narrow insulating strips provided with adhesive on both surfaces thereof and removably connected to the guide sheet at predetermined spaces, facilitating accurate winding of insulating strips on a bobbin or the like and further enabling the winding operation to be carried out automatically.

4 Claims, 4 Drawing Sheets

INSULATING TAPE FOR WINDING COILS

This application is a divisional, of application Ser. No. 07/611,781, filed Nov. 13, 1990, now abandoned.

BACKGROUND OF THE INVENTION

1. Field of the Invention

This invention relates to an insulating tape used for producing winding coils which are usually used in electric apparatus such as home electric appliances or in electronic devices used in telecommunication systems or the like.

2. Description of the Related Art

In electric apparatus such as home electric appliances or in electronic devices used in telecommunication systems or the like, the winding coils used as the switching transformers or the like usually have the construction as shown in FIG. 3, with wirings 21 and insulated tape 22 alternately wound on a bobbin 10.

The bobbin 10 has rim portions 12 and 13 provided on both ends of a body portion 11 thereof, as shown in FIG. 4.

One of the rim portions, for example, the rim portion 12, has a plurality of terminal portions 14 projected from a side surface.

These bobbins 10 usually are given a common configuration instead of preparing several kinds of bobbins with different configurations for each winding coil. An insulating layer is usually formed on the body portion 11 of the bobbin 10 by winding narrow, insulating strips on the two side edge portions or one of the side edge portions, depending on the amount of wiring to be wound on the bobbin or the width of the winding in each winding layer.

The manufacturing steps for producing the winding coil explained above illustrated in FIG. 5-A to 5-F.

In these figures, each bobbin 10 is shown schematically. One of the rim portions 12 thereof is omitted from each drawing to make them more understandable.

First, narrow insulating strips 23 having a predetermined width are wound on both side edge portions of the body portion 11 to form ridged portions 23A and 23B, respectively (as shown in FIG. 5-A).

When an end portion of the wiring material 21 is terminated with a predetermined terminal 14, not shown in FIG. 5-B, it is wound on the body portion 11 of the bobbin 10 starting at the edge portion of the ridged portion 23A (as shown in FIG. 5-B).

After a certain amount of the wiring material 21 is wound on the body portion 11 along a longitudinal direction thereof and when the wiring material 21 reaches a position on which an end portion of the other ridged portion 23B exists (as shown in FIG. 5-C), an adhesive is coated over the whole surface of the wiring material 21 just wound on the body portion 11, then a predetermined amount of an insulating tape 22 having the same width as that of the body portion 11 is wound on the adhesive layer.

After that, the wiring material 21 is folded on the surface of the insulating tape 22 toward the terminal 14 (as shown in FIG. 5-D).

When the wiring material 21 is entangled with the terminal 14, a predetermined amount of the insulating tape 22 is wound again on the body portion 11 to cover the wiring material 21 arranged on the previously wound insulating tape 22 (as shown in FIG. 5-E).

When a first wiring layer is formed by the operation as explained above, two narrow insulating strips 23 having a predetermined width are wound on the two end portions of the insulating tape 22 to form ridged portions 23A and 23B (as shown in FIG. 5-F).

Then, the wire winding operation as explained above is again carried out to form a second wiring layer, etc. Finally, a wiring coil is produced provided with a plurality of wiring layers, as shown in FIG. 3.

As explained above, the wiring coil thus produced includes the narrow insulating strips 23 which form the ridged portions 23A and 23B as insulated layers.

However, the narrow insulating strips have extremely small stiffness and strength since they are 0.05 to 1.0 mm in thickness and 2 to 10 mm in width.

Accordingly, when the narrow insulating strips 23 are wound on the bobbin 10 or on a surface of the wiring material 21, the insulating strips 23 are twisted even with a slight tension applied thereto. This makes it difficult for the insulating strips 23 to be wound precisely on a predetermined place.

Also, when tension is applied to the insulating strips 23, they are deformed, for example, are reduced in the thickness or the width, or are broken, to make it difficult to form a predetermined insulating layer.

Therefore, insulating strips having relatively high stiffness and strength should be used. Further, the operator should wind the insulating strips on the bobbin with a great care so as not to apply unnecessary tension thereto.

This causes a problem of extremely low operational efficiency for producing the wiring coils.

SUMMARY OF THE INVENTION

The object of the present invention is to provide an insulating tape for winding coils which facilitates accurate winding of insulated strips on a bobbin or the like in a wiring coil producing method and further enables the winding operation to be carried out automatically.

To attain the object of the present invention, there is provided an insulating tape for winding coils which includes a guide sheet having a predetermined width and a plurality of narrow insulating strips provided with adhesive on both surfaces thereof and removably connected to the guide sheet at predetermined spaces.

DESCRIPTION OF THE PREFERRED EMBODIMENTS

Figure 1:
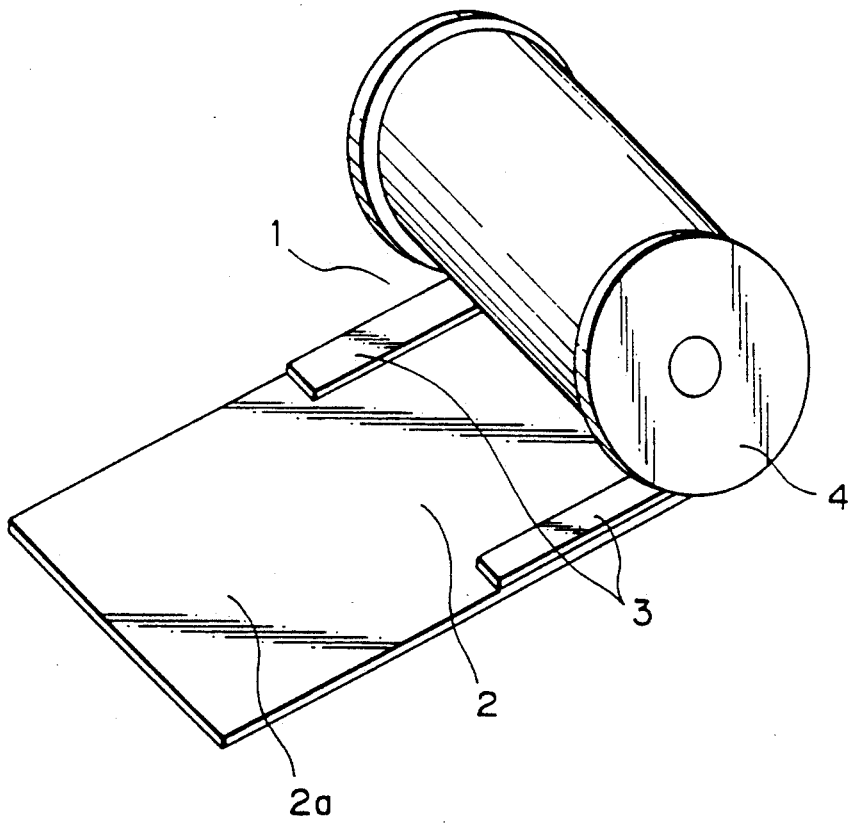
FIG. 1 is a schematic perspective view of one embodiment of an insulating tape for winding coils of the present invention.

A preferred embodiment of the present invention will be explained with reference to the attached figures hereunder.

As explained above, the insulating tape 1 for winding coils of the present invention includes guide sheet 2 having a predetermined width and a plurality of narrow insulating strips 3 provided with adhesive on both surfaces thereof and removably connected to the guide sheet at predetermined spaces.

The guide sheet 2 is made of a nonadhesive sheet-like material such as paper or plastic film.

The insulating strips 23 are made of an epoxy resin impregnated fabric tape.

The insulating tape for winding coils 1 of the present invention is wound on a reel 4 or the like made of paper or plastic. At one end, there is a portion on which the narrow insulating strips 3 are not provided to form a portion 2*a* to be wound on a winding reel 5.

Figure 2:
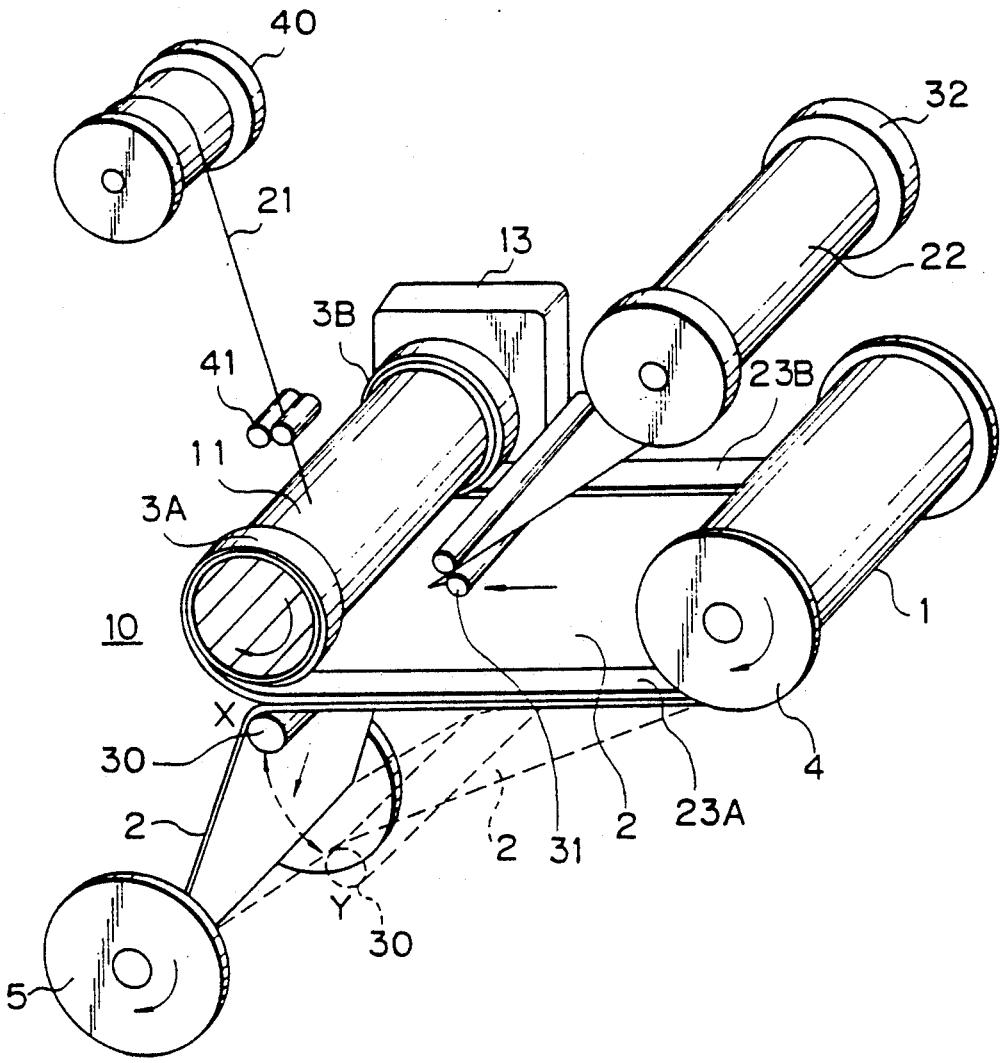
FIG. 2 is a schematic view of one embodiment of a winding operation of an insulating tape for winding coils of the present invention.
Figure 3:
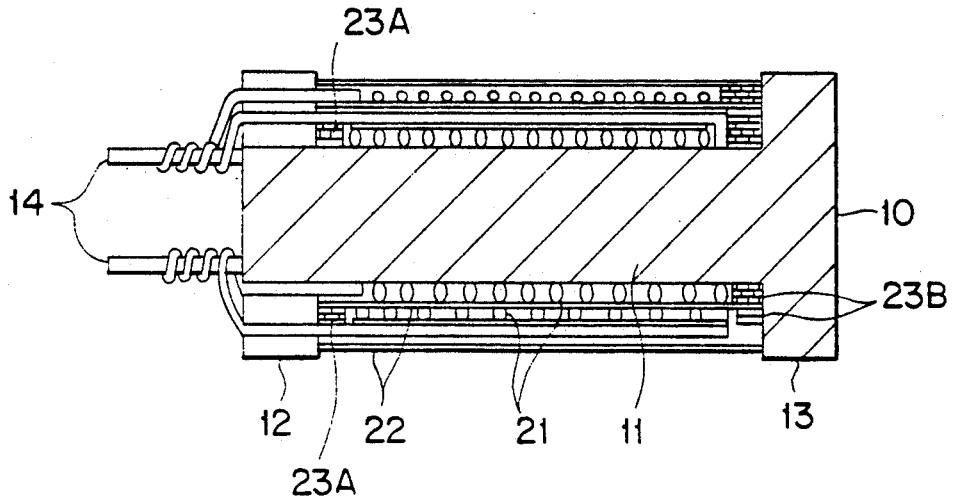
FIG. 3 is a schematic cross-sectional view of one embodiment of a wiring coil.
Figure 4:
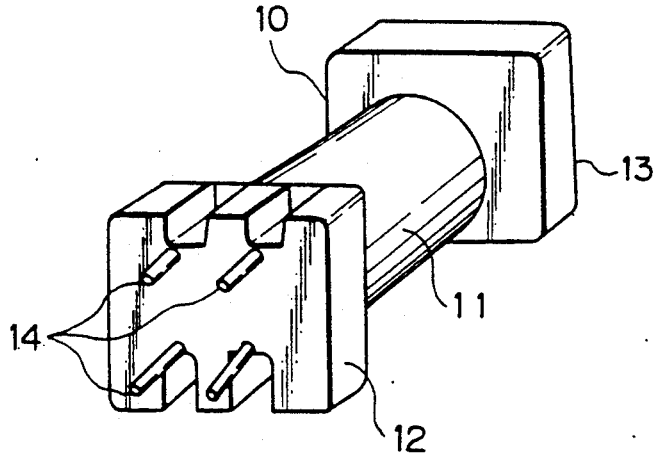
FIG. 4 is a schematic perspective view of one embodiment of a construction of a wiring coil used in the present invention.
Figure 5A:
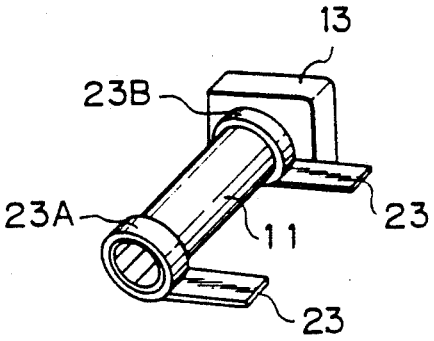
FIGS. 5A to 5B are schematic views of steps in a wiring coil producing method.
Figure 5B:
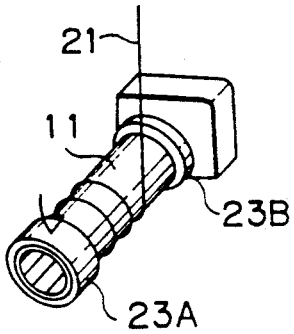
Figure 5C:
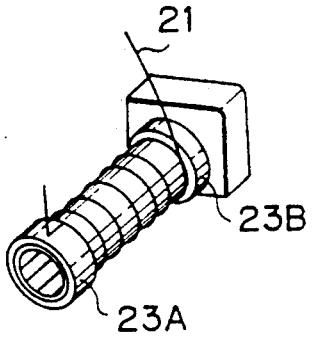
Figure 5D:
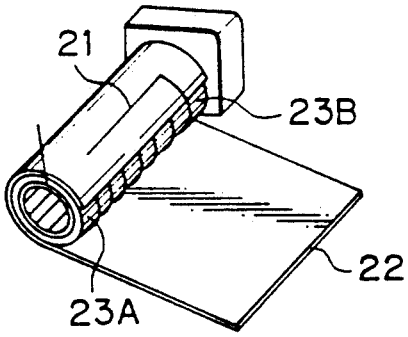
Figure 5E:
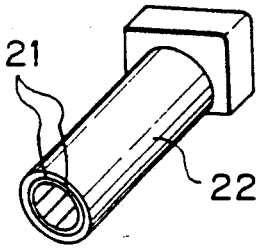
Figure 5F:
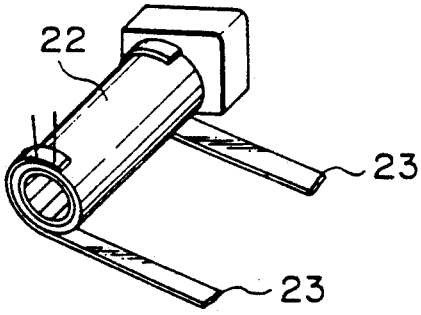

When a wiring coil is produced utilizing the insulating tape 1, as shown in FIG. 2, the reel 4 on which the insulating tape is wound is mounted on a chuck (not shown) rotatably supported on a machine frame (not, shown) or a movable arm (not shown) moving in both the vertical and horizontal directions, then the end of the guide sheet 2 is withdrawn from the reel 4 and wound on a reel 5.

After this preparatory operation is completed, the wiring winding operation and the insulated tape 22 winding operation are started.

The narrow insulating strips 23 are wound on a bobbin 10 while moving a pressing means 30 or a movable arm to a surface of the bobbin 10 or a surface of wound insulated tape 22 to make the insulating strips 2 contact to the surface while the bobbin is rotated.

Therefore, the insulating strips 23A and 23B are adhered to the end surfaces of the bobbin in predetermined lengths by the rotation of the bobbin 10 to form the ridge portions 3A and 3B, respectively.

After the predetermined lengths of the insulating strips 23A and 23B are wound on the bobbin 10, the rotation of the bobbin is stopped. The pressing means 30 is removed from a contact position X at which the insulating strips 23 contact the surface of the bobbin and is moved to a position Y at which the insulating strips 23 do not contact the surface of the bobbin.

Simultaneously with this movement of the pressing means 30, the insulating strips 23A and 23B are cut with a suitable cutter (not shown).

Then, the rotation of the winding bobbin 5 for winding the guide sheet 2 is stopped.

After that, the bobbin 10 is started rotating to wind the wiring material 21 delivered from a reel 40 through a suitable guide member 41 on the surface of the bobbin 10 and between the ridge portions 3A and 3B.

After a predetermined amount of wiring material 21 is wound on the bobbin, an insulating tape 22 delivered from a reel 32 through a suitable guide member 31 is wound on the bobbin 10 to cover the wiring material 21 and the ridge portions 3A and 3B.

If required, a portion of the wiring material 21 is folded on the surface of the insulating tape 22 and covered with the tape 22 during the sheet winding operation as shown in FIGS. 5-D and 5-E.

Then, the pressing means 30 is again moved to the position X to bring the insulating strips in contact to the surface of the insulating sheets previously wound thereto and covering a portion of the wiring material 21 to form stacked ridge portions.

The same operation as explained above is repeated.

In this operation, the guide sheet 2 provided with the insulating strips 23 is guided by the rim portions 12 and 13 of the bobbin.

As explained above, since the insulating tape 1 of the present invention includes a guide sheet 2 having a wide width and a plurality of narrow insulating strips provided with adhesive on both surfaces thereof and since the guide sheet 2 has relatively high stiffness and high strength, there is no deformation or twisting due to tension or other external force applied thereto.

Accordingly, the narrow insulating strips can be accurately wound on the surface portion of the bobbin along the rim portions 12 and 13.

On the other hand, the guide sheet 2 is wound on the reel 5 after the narrow insulating strips 23 are removed therefrom and wound on the surface of the bobbin 10.

According to the insulating tape for winding coils of the present invention, the narrow insulating strips can be precisely wound at predetermined defined positions of the bobbin just by arranging an end of the guide sheet at a predetermined winding position with respect to the bobbin.

Also, an insulating layer having predetermined dimensions can be formed without deformation or twisting of the narrow insulating strips caused by tension or the like in the winding operation, since the narrow insulating strips are placed on the guide sheet.

Moreover, the operation for winding the narrow insulating strips on the surface of the bobbin can be carried out utilizing an automatic apparatus, resulting an improved production efficiency in the wiring coil production.

I claim:

1. A method of producing a winding coil comprising the steps of:

providing an insulating narrow strip guiding tape wound on a reel, said insulating narrow strip guiding tape including a guide sheet and a plurality of insulating narrow strips provided on the guide sheet, said insulating narrow strips being provided with adhesive on opposite surfaces thereof;

winding the insulating narrow strips from the reel onto a first bobbin to adhere the insulating narrow strips on the bobbin and form first ridge portions while also winding the guide sheet on a second bobbin;

ceasing winding of the insulating narrow strips on the first bobbin after a predetermined length of the insulating narrow strips have been wound on the first bobbin, and cutting the insulating narrow strips; and winding siring material on the first bobbin between the first ridge portions.

2. The method of producing a winding coil according to claim 1, including winding a first layer of insulating tape on the first bobbin to cover the wiring material and the first ridge portions.

3. The method of producing a winding coil according to claim 2, including winding the insulating narrow strips on the first bobbin to adhere the insulating strips to the first layer of insulating tape to form second ridge portions while also winding the guide sheet on the second bobbin, ceasing winding of the insulating narrow strips on the first bobbin after a predetermined length of the insulating narrow strips have been wound on the first bobbin, cutting the insulating narrow strips, and winding a second layer of wiring material on the first bobbin between the second ridge portions.

4. The method of producing a winding coil according to claim 3, including winding a second layer of insulating tape on the first bobbin to cover the second layer of wiring material and the second ridge portions.

* * * * *